United States Patent [19]

Nemoto et al.

[11] 4,027,936

[45] June 7, 1977

[54] CONNECTOR HAVING ELECTRO-CONDUCTIVE RUBBER TERMINAL

[75] Inventors: Hideo Nemoto, Sakura; Yuuji Koike, Matsudo, both of Japan

[73] Assignee: Kabushiki Kaisha Daini Seikosha, Japan

[22] Filed: July 16, 1975

[21] Appl. No.: 596,219

[30] Foreign Application Priority Data

July 22, 1974 Japan ..... 49-86968[U]

[52] U.S. Cl. ..... 339/59 M; 339/DIG. 3

[51] Int. Cl.[2] ..... H01R 11/02

[58] Field of Search ..... 339/17 M, 17 LM, 59 R, 339/59 M, DIG. 3, 17 A, 17 B, 17 CF, 17 E, 17 L, 17 LC, 17 N; 29/630 R

[56] References Cited

UNITED STATES PATENTS

| | | | |
|---|---|---|---|
| 3,531,581 | 9/1970 | Chesemore | 339/17 LC |
| 3,680,037 | 7/1972 | Nellis et al. | 339/DIG. 3 |
| 3,861,135 | 1/1975 | Seeger et al. | 339/DIG. 3 |
| 3,880,486 | 4/1975 | Avakian | 339/DIG. 3 |

*Primary Examiner*—Gerald A. Dost
*Attorney, Agent, or Firm*—Robert E. Burns; Emmanuel J. Lobato; Bruce L. Adams

[57] ABSTRACT

A connector having electro-conductive rubber terminals is composed of an insulated casing having a plurality of recessed portions and a plurality of rubber terminal portions, of electro-conductive rubber inserted in respective ones of the recesses. The rubber terminals are connected together in rows to a runner and are inserted by rows into the recessed portions and then the terminals are cut from the runner whereby said terminal portions are attached to said insulated casing.

1 Claim, 3 Drawing Figures

CONNECTOR HAVING ELECTRO-CONDUCTIVE RUBBER TERMINAL

BACKGROUND OF THE INVENTION

This invention relates to a connector composed of an insulated casing having a plurality of recessed portions, and a plurality of rubber terminal portions of electro-conductive rubber inserted in respective ones of the recessed portions.

The conventional insert type connector comprises a male pin and female contact pin, however it is very difficult to manufacture such connectors for use in an electronic wrist watch, small electronic computer and camera.

Further, in the conventional connector it is necessary to insert each terminal of the electro-conductive silicon rubber to the connector casing by hand working, therefore there are many drawbacks and problems due to the manual labor involved and the length of assembly time.

OBJECT OF THE INVENTION

The present invention aims to eliminate the above noted difficulty and insufficiency, and therefore it is the primary object of the present invention to provide a new connector having electro-conductive rubber terminals, and it is a further object of the present invention is to provide a new method of manufacturing such a connector.

SUMMARY OF THE INVENTION

According to the present invention, there is provided a connector having composed of an insulated casing having a plurality rubber terminal portions of electro-conductive rubber, and a plurality of rubber terminals formed of electro-conductive material inserted in respective ones of the recessed portions.

BRIEF DESCRIPTION OF THE DRAWINGS

The above mentioned and further objects, features and advantages of the present invention will become more obvious from the following description when taken in connection with the accompanying drawings, which show one preferred embodiment, and wherein.

DETAILED DESCRIPTION OF THE INVENTION

This invention relates to a connector having electro-conductive rubber terminals for use in an electronic wrist watch, small electronic computer and camera.

Figure 1:
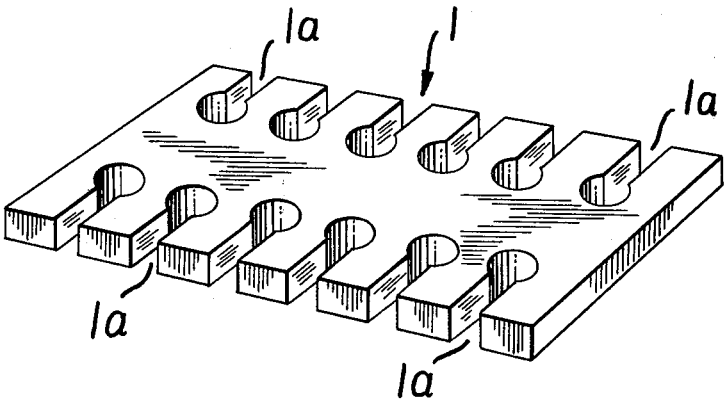
FIG. 1 shows a perspective view of the connector casing of the present invention.

Referring now to one embodiment of the present invention, FIG. 1 shows an insulated connector casing 1 having a plate-like shape and having rows of keyhole-shaped recessed portions 1*a* along both marginal side edges of said connector casing 1, the recessed being spaced at suitable intervals. Each recess 1*a* has a linear portion extending inwardly a given distance from the peripheral edge of the casing 1 and the linear portion terminates in an enlarged opening portion. This embodiment shows six recessed portions on both sides of said casing, however the connector of the present invention is not restricted to this number nor shape of recessed portions. The recessed portions may be provided on only one side or all sides of said connector casing.

Figure 2:
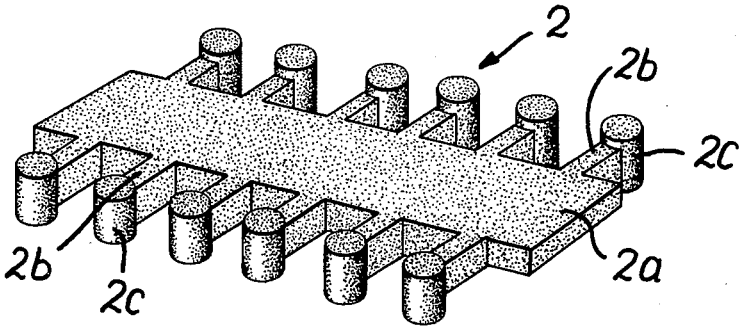
FIG. 2 shows a perspective view of the formation of the electro-conductive rubber insert.
Figure 3:
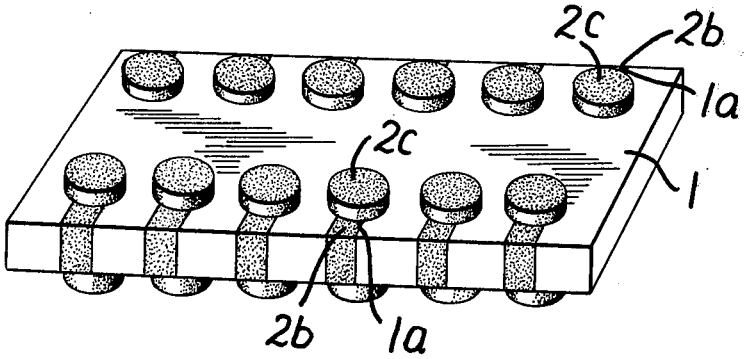
FIG. 3 shows a perspective view of the connector assembly comprised of the connector casing and the electro-conductive rubber insert.

FIG. 2 shows one embodiment of an electro-conductive insert member 2 of electro-conductive silicon rubber having a plurality of terminals, said rubber member has a plurality of enlarged cylindrical terminal portions 2*c* at the distal ends of respective branch portions 2*b* which extend from both side portions of an enlarged runner 2*a*.

Further, said cylindrical terminal portions 2*c* are shaped to extend beyond the upper and lower major surfaces of faces of said connector casing 1 when said terminal portions 2*c* are inserted into said recessed portions 1*a* of said connector casing 1.

It is understood that the number of said terminals and the location of said terminals correspond to the number and location of the recesses in said connector casing.

Referring now to the method of making the connector composed of the insulated connector casing 1 and said electro-conductive silicon rubber insert, first of all, inserting one row of branch portions 2*b* and corresponding terminal portions 2*c* of said rubber member 2 is inserted into one row of recessed portions 1*a* of said insulated connector casing 1 at one time from either above or below said insulated connector casing 1.

Then the row of branch portions 2*b* is cut from said runner 2*a* at the side edge of said insulated connector casing 1. This technique is repeated to attach the other row of terminal portions 2*c*.

Therefore, according to the present invention, said insulated connector casing and said electro-conductive silicon rubber insert are connected together by inserting a plurality of said terminals to said connector casing at one time whereby the need for inserting said terminals to said connector casing one by one with hand is eliminated thereby reducing the manufacturing time and cost.

Furthermore, the connector of the present invention is suitable for use in the manufacture of small electronic devices including a small computer and electronic wrist watch.

What we claim is:

1. A connector having electro-conductive rubber terminals comprising: an electrically insulated casing having a platelike shape and having along at least one of its outer marginal side edges a row of recesses, each recess having a generally keyhole configuration defined by a linear portion extending inwardly a given distance from the peripheral edge of said casing and terminating in an enlarged opening portion; and a plurality of electro-conductive rubber terminals disposed within respective ones of said recesses, each rubber terminal having a generally keyhole configuration defined by a branch portion lying within its corresponding recess linear portion and terminating in an enlarged terminal portion lying within its corresponding recess opening portion, said enlarged terminal portion projecting in a direction transverse to said platelike casing beyond both major surfaces of said casing, said enlarged terminal portion of each rubber terminal having a cylindrical shape both ends of which project beyond said major surfaces of said casing, and said branch portion of each rubber terminal lying flush with both major surfaces of said casing.

* * * * *